US011092044B2

(12) United States Patent
Onishi

(10) Patent No.: US 11,092,044 B2
(45) Date of Patent: Aug. 17, 2021

(54) CYLINDER HEAD

(71) Applicant: Mazda Motor Corporation, Hiroshima (JP)

(72) Inventor: Takakazu Onishi, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/782,340

(22) Filed: Feb. 5, 2020

(65) Prior Publication Data

US 2020/0378279 A1 Dec. 3, 2020

(30) Foreign Application Priority Data

May 28, 2019 (JP) ..... JP2019-099540

(51) Int. Cl.

| | |
|---|---|
| ***F02F 1/24*** | (2006.01) |
| ***F01L 1/24*** | (2006.01) |
| ***F01L 1/18*** | (2006.01) |
| ***F02F 1/18*** | (2006.01) |

(52) U.S. Cl.

CPC ..... *F01L 1/2405* (2013.01); *F01L 1/18* (2013.01); *F02F 1/183* (2013.01); *F02F 1/24* (2013.01)

(58) Field of Classification Search

CPC ..... F01L 1/185; F01L 1/2405; F02F 1/24
USPC ..... 123/90.43, 90.46
See application file for complete search history.

(56) References Cited

U.S. PATENT DOCUMENTS

| | | | | |
|---|---|---|---|---|
| 4,644,913 | A * | 2/1987 | Stoody, Jr. | F01L 1/2405 123/90.46 |
| 2003/0094155 | A1* | 5/2003 | Shimoyama | F01L 1/053 123/188.2 |
| 2007/0215081 | A1* | 9/2007 | Frincke | F01L 1/2405 123/90.16 |
| 2007/0261652 | A1* | 11/2007 | Neal | F01L 13/0036 123/90.48 |
| 2014/0190450 | A1* | 7/2014 | Uemizu | F01L 1/14 123/432 |
| 2018/0030920 | A1* | 2/2018 | Wicks | F02F 7/0085 |
| 2018/0156077 | A1* | 6/2018 | Brune | F01L 1/182 |
| 2018/0179922 | A1* | 6/2018 | Takehana | F01L 1/185 |
| 2018/0252170 | A1* | 9/2018 | Hashimoto | F01L 13/0005 |
| 2020/0049031 | A1* | 2/2020 | Nishimoto | F02D 13/06 |
| 2020/0191022 | A1* | 6/2020 | Erickson | F01L 1/185 |

FOREIGN PATENT DOCUMENTS

JP 2018059439 A 4/2018

* cited by examiner

*Primary Examiner* — Jorge L Leon, Jr.
(74) *Attorney, Agent, or Firm* — Alleman Hall Creasman & Tuttle LLP

(57) ABSTRACT

A cylinder head, where a pivot member configured to pivotably support a rocker arm is fastened with a bolt, is provided. The cylinder head includes a bottom wall part forming an inner bottom surface of a cam chamber that is a space where the rocker arm is disposed, and a side wall part forming an internal surface continuously rising from the inner bottom surface. A bolt hole into which the bolt is inserted is formed in the inner bottom surface. The side wall part has a protrusion protruding inward in the cam chamber from the internal surface at a position separated from the inner bottom surface, and a support hole configured to support the pivot member is formed in the protrusion.

9 Claims, 12 Drawing Sheets

CYLINDER HEAD

TECHNICAL FIELD

The present disclosure relates to a cylinder head into which a pivot member, such as a lash adjuster for pivotably supporting a rocker arm is incorporated.

BACKGROUND OF THE DISCLOSURE

Conventionally, for example, JP2018-059439A discloses a lash adjuster (HLA: Hydraulic Lash Adjuster) of a hydraulic operation type which automatically and hydraulically carries out a zero-point adjustment of a valve clearance as a pivot member (mechanism) for pivotably supporting a rocker arm (swing arm).

The HLA is disposed in a side wall part of a cam chamber formed in an upper surface of a cylinder head. This is to supply oil pressure for operating the HLA through the inside of the side wall part. In detail, in the side wall part (side surface) of the cam chamber, a part protruding inwardly in the cam chamber while being coupled to an inner bottom part (inner bottom surface) is formed, and the HLA is attached to (incorporated into) a hole formed in the protruding part. An oil-pressure supply passage is formed inside the side wall part, and this oil-pressure supply passage communicates with the hole. Therefore, the oil pressure for operation is supplied to the HLA attached to the hole.

In engines, a fastening position of a cylinder head and a cylinder block with bolts and nuts may be set inside the cam chamber. That is, bolt holes are formed in the inner bottom surface of the cam chamber, bolts are inserted into the bolt holes from the cam chamber side, and the bolts are inserted into and threadedly engaged with nut members embedded in the cylinder block.

With such a structure, if the fastening force of the bolts and nuts are too large, the inner bottom surface of the cam chamber may be deformed, and according to this deformation, stress occurs in a boundary part between the inner bottom surface and the protruding part (i.e., the side wall part) of the cam chamber, thereby causing a crack at the boundary part in a worst case scenario. In particular, since in high compression type engines (diesel engine, etc.) the cylinder head and the cylinder block are fastened with a large fastening force in order to prevent leaks of combustion gas, the above-described inconvenience may occur.

In order to avoid such an inconvenience, for example, it is possible to increase the thickness of the wall part which forms the cam chamber and to increase the strength of the cylinder head. However, this will be accompanied by a decrease in fuel efficiency and a cost increase due to the weight increase in the cylinder head, and thereby, this is not ideal.

SUMMARY OF THE DISCLOSURE

The present disclosure is made in view of the above situations, and one purpose thereof is to provide a technology which is capable of easing stress generated by fastening a cylinder head and a cylinder block, without increasing the weight of the cylinder head.

In order to solve the problem described above, according to one aspect of the present disclosure, a cylinder head, where a pivot member configured to pivotably support a rocker arm is fastened with a bolt, is provided. The cylinder head includes a bottom wall part forming an inner bottom surface of a cam chamber that is a space where the rocker arm is disposed, and a side wall part forming an internal surface continuously rising from the inner bottom surface. A bolt hole into which the bolt is inserted is formed in the inner bottom surface. The side wall part has a protrusion protruding inward in the cam chamber from the internal surface at a position separated from the inner bottom surface, and having a support hole configured to support the pivot member.

According to this configuration, since the part at which the pivot member is supported (i.e., the protrusion) is separated from the inner bottom surface of the cam chamber, a position of stress generated by the fastening of the bolt is separated from the bolt fastening position by a separation amount of the protrusion compared to a conventional cylinder head. The magnitude of the stress in this case becomes larger as the distance from the fastening position to the generated position of the stress is shorter. Therefore, according to this configuration, it is possible to reduce (ease) the stress, compared to the conventional cylinder head, without increasing the thickness of the wall part which forms the cam chamber, and accordingly, without increasing the weight of the cylinder head.

A part of the internal surface, facing a space between the protrusion and the inner bottom surface, may be recessed in a direction along the inner bottom surface heading away from the bolt hole.

According to this configuration, the generated position of the stress is further separated from the bolt fastening position. Therefore, the stress can be further eased.

In this case, the recessed part of the internal surface may have a curved shape or a rectangular shape in cross-section.

According to this configuration, the generated position of the stress can be separated from the fastening position of the bolt with a simple configuration.

Note that the pivot member which pivotably supports the rocker arm may be a lash adjuster of a hydraulic operation type configured to automatically and hydraulically carry out a zero-point adjustment of a valve clearance. In the case where the lash adjuster is applied, oil pressure for operating the lash adjuster needs to be supplied through the inside of the side wall part of the cylinder head, and therefore, the lash adjuster also needs to be incorporated in (supported by) the side wall part.

Thus, the configuration of the cylinder head described above is useful especially for the cylinder head in which the lash adjuster of hydraulic operation type is incorporated as the pivot member.

Moreover, the cam chamber may have a rectangular shape in a plan view, the bolt hole may be formed substantially at the center of the inner bottom surface, and the pivot member may be disposed at a corner part of the cam chamber in the plan view.

As described above, according to the configuration in which the bolt is fastened at the center of the cam chamber (the inner bottom surface) of the rectangular shape in a plan view, and the pivot member is disposed at the corner part of the cam chamber, as a result of the depression of the inner bottom surface centering on the bolt (the bolt hole), the deformation of the inner bottom surface influences also the corner part of the cam chamber. Therefore, the configuration described above is useful also in the case where the bolt hole is formed at the center of the cam chamber, and the pivot member is disposed at the corner part of the cam chamber.

DETAILED DESCRIPTION OF THE DISCLOSURE

Hereinafter, one embodiment of the present disclosure is described in detail with reference to the accompanying drawings.

[1. Engine Structure]

Figure 1:
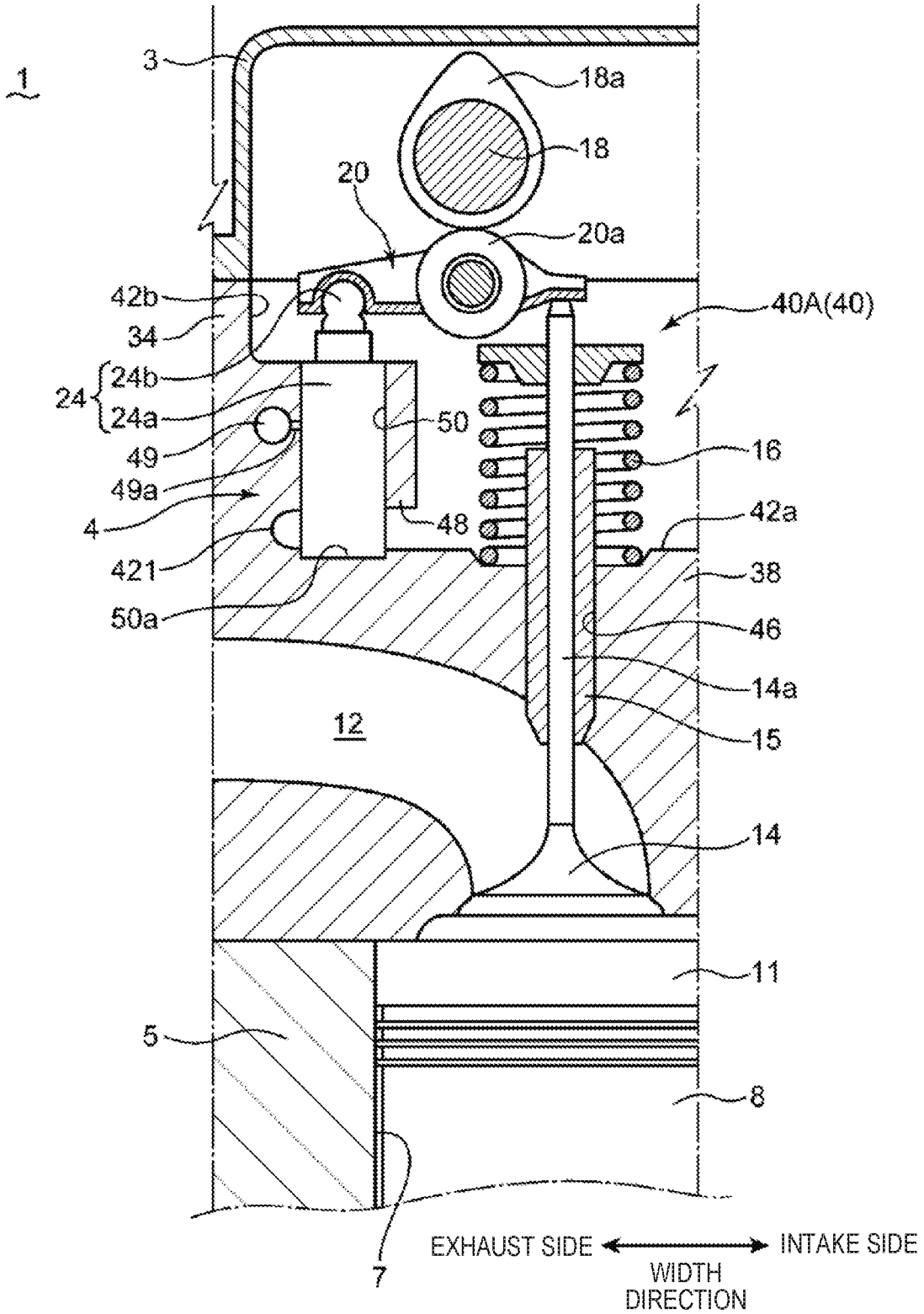
FIG. 1 is a cross-sectional view illustrating a substantial part of an engine provided with a cylinder head according to the present disclosure.

FIG. 1 is a cross-sectional view of a substantial part of an engine provided with a cylinder head according to the present disclosure. An engine 1 illustrated in this figure is an engine for a vehicle, such as an automobile. This engine 1 is an in-line multiple cylinder gasoline engine in which a plurality of cylinders are lined up in a direction perpendicular to the paper surface of this drawing, and FIG. 1 illustrates a cross-section on the exhaust side when the engine 1 is seen from one side in the cylinder lined-up direction. Note that in the following description, otherwise particularly described, the cylinder lined-up direction of the engine 1 is a front-and-rear direction of the engine, and a direction perpendicular to this direction is a width direction of the engine (intake and exhaust direction).

The engine 1 includes a head cover 3, a cylinder head 4, a cylinder block 5, a crank case (not illustrated), and an oil pan (not illustrated) which are coupled in series in the vertical direction. A plurality of cylinder bores 7 are formed in the cylinder block 5, and a piston 8 is slidably accommodated inside each cylinder bore 7. A combustion chamber 11 is formed by the piston 8, the cylinder bore 7, and the cylinder head 4, for every cylinder. The piston 8 of each cylinder is coupled to a crankshaft (not illustrated) rotatably supported by the crank case through a connecting rod (not illustrated).

The cylinder head 4 is provided with two exhaust ports 12 which open to each combustion chamber 11 and two exhaust valves 14 which open and close the respective exhaust ports 12.

The exhaust valve 14 is biased by a return spring 16 in a direction to close the exhaust port 12 (upward in FIG. 1), and is configured to open the exhaust port 12 by being pushed down by a cam part 18*a* provided around an exhaust-side cam shaft 18. In detail, as the exhaust-side cam shaft 18 is rotated, the cam part 18*a* pushes down a cam follower 20*a* provided in a substantially central part of a rocker arm 20. Then, the rocker arm 20 pivots using a top of a hydraulic lash adjuster 24 provided at one end side thereof, as a fulcrum. This pivoting then causes the other end part of the rocker arm 20 to push down the exhaust valve 14 while resisting a biasing force of the return spring 16. Therefore, the exhaust port 12 opens.

Note that the hydraulic lash adjuster 24 (hereinafter, referred to as "HLA 24") is one example of a pivot member (mechanism) which pivotably supports the rocker arm 20, and is to automatically carry out a zero-point adjustment of a clearance between the rocker arm 20 and the exhaust valve 14 (valve clearance) by hydraulically pushing up the rocker arm 20.

Although illustration is omitted, on the right side of the cylinder head 4 in FIG. 1, two intake ports which open to each combustion chamber 11 and two intake valves which open and close the respective intake ports are provided. Similar to the exhaust valve 14, the intake valve is biased in a direction to close the intake port by a return spring, and opens and closes the intake port when the intake-side cam shaft is rotated. That is, as the intake-side cam shaft is rotated, the cam part pushes down a cam follower of a rocker arm. Then, the rocker arm pivots using a top of the HLA 24 provided at one end side thereof, as a fulcrum, and this pivoting causes the other end part of the rocker arm to push the intake valve while resisting a biasing force of the return spring. Therefore, the intake port opens. Note that although omitted in FIG. 1, the intake side is configured to be substantially symmetrical with the exhaust side in FIG. 1.

[2. Structure of Cylinder Head 4]

Figure 2:
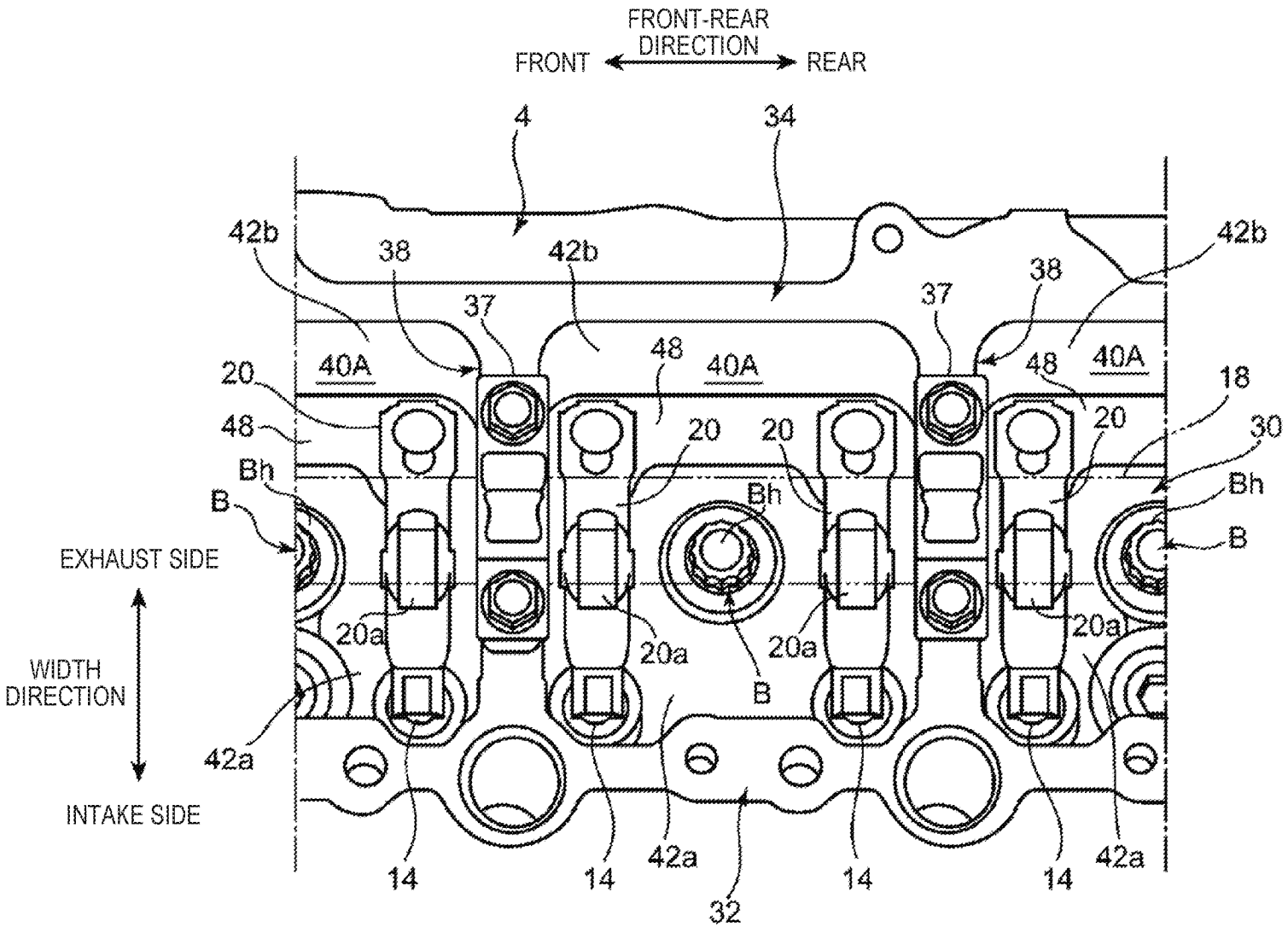
FIG. 2 is a plan view illustrating a substantial part of the engine in a state where a head cover is removed.
Figure 3:
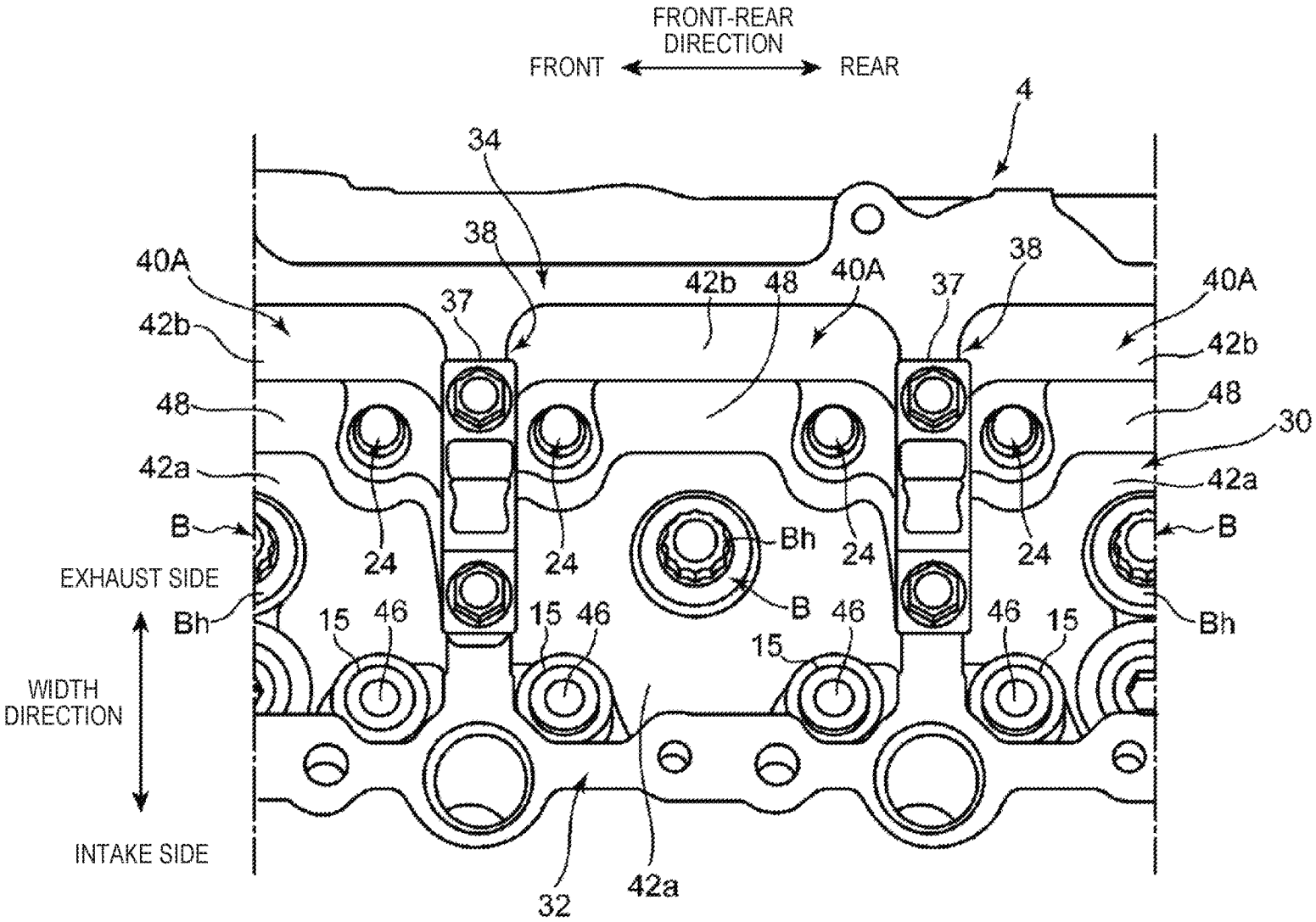
FIG. 3 is a plan view illustrating a substantial part of the engine in a state where an exhaust-side cam shaft and a rocker arm are removed.
Figure 4:
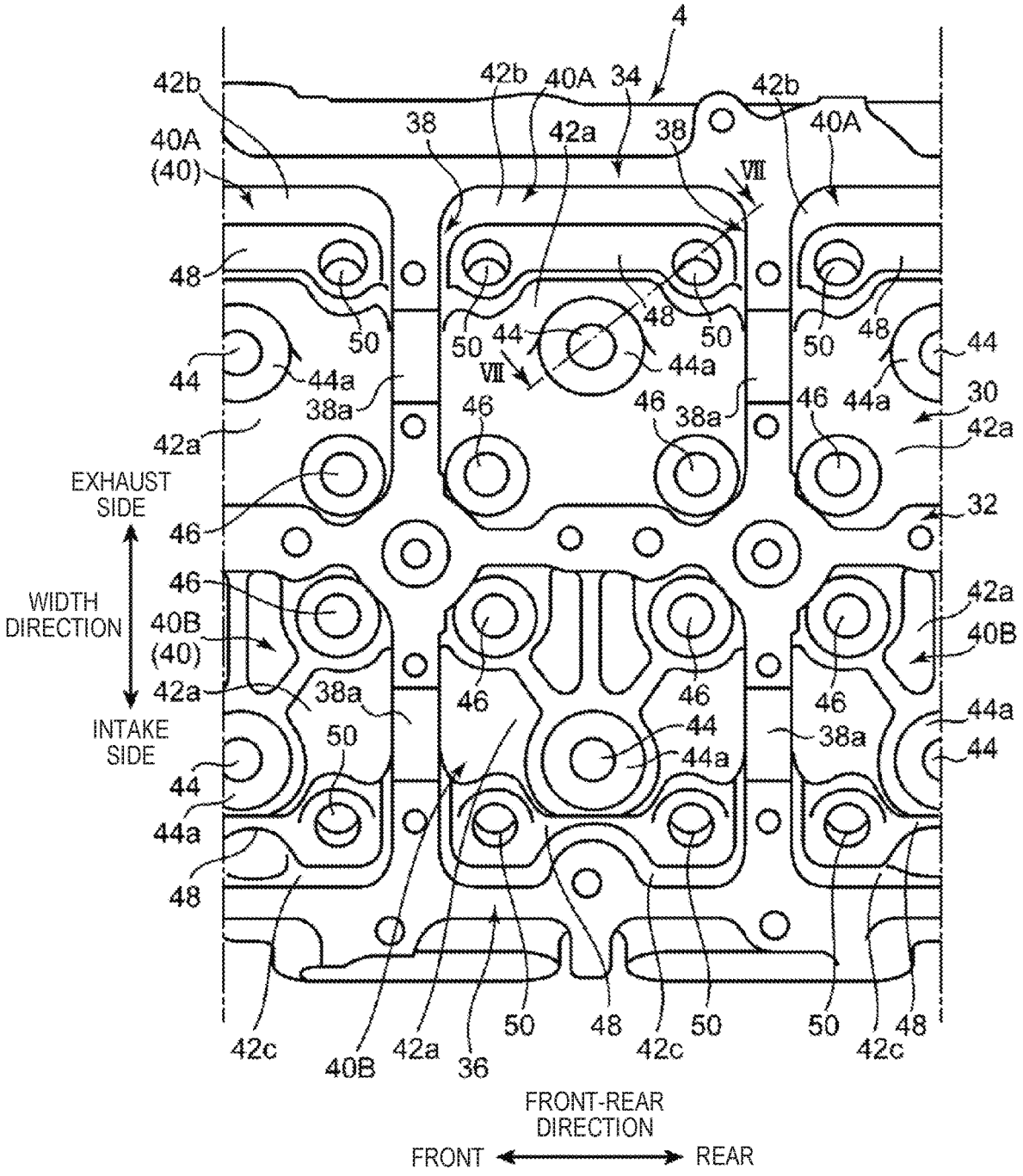
FIG. 4 is a plan view illustrating a substantial part of the cylinder head alone.

FIG. 2 is a plan view illustrating a substantial part of the engine 1 in a state where the head cover 3 is removed (i.e., the cylinder head 4), FIG. 3 is a plan view illustrating a substantial part of the engine 1 in a state where the exhaust-side cam shaft 18 and the rocker arm 20 are removed, and FIG. 4 is a plan view illustrating a substantial part of the cylinder head alone.

The cylinder head 4 has a head body 30 where the exhaust port 12, the intake port (not illustrated), etc. are formed (an example of a "bottom wall part" of the present disclosure). In an upper part of the head body 30, a central wall part 32 extending in the front-and-rear direction so as to pass through the center of each cylinder bore 7 in the plan view, an exhaust-side wall part 34 extending in the front-and-rear direction at a position separated from the central wall part 32 to the exhaust side, an intake-side wall part 36 extending in the front-and-rear direction at a position separated from the central wall part 32 to the intake side, a plurality of partition wall parts 38 each extending in the width direction at a plurality of positions in the front-and-rear direction of the head body 30, covering the wall parts 34 and 36 are provided so as to stand. Therefore, a plurality of cam chambers 40, which are the spaces where the rocker arm 20, etc. are disposed, are formed in the upper part of the cylinder head 4 in a grid shape. In detail, a plurality of exhaust-side cam chambers 40A of substantially square shapes in the plan view lined up in the front-and-rear direction, and a plurality of intake-side cam chambers 40B (the same number as the exhaust-side cam chambers 40A) of substantially square shapes in the plan view lined up in the front-and-rear direction, are formed in two rows.

As illustrated in FIG. 2, the exhaust-side cam shaft 18 is disposed above each exhaust-side cam chamber 40A so as to extend in the front-and-rear direction. The exhaust-side cam shaft 18 is supported via an oil film by a support recess 38*a* formed in an upper surface of each partition wall part 38, and is rotatably held by a cam shaft cap 37 and the partition wall part 38.

Although illustration is omitted, the intake-side cam shaft is disposed above each intake-side cam chamber 40B so as to extend in the front-and-rear direction. Similar to the exhaust-side cam shaft 18, the intake-side cam shaft is rotatably held by the cam shaft cap 37 and the partition wall part 38.

A bolt hole 44 and a valve hole 46 are formed in an inner bottom surface 42*a* of the exhaust-side cam chamber 40A. The bolt hole 44 is a hole into which a head bolt B for fastening the cylinder head 4 with the cylinder block 5 is inserted, and the valve hole 46 is a hole into which the exhaust valve 14 is inserted.

Figure 6:
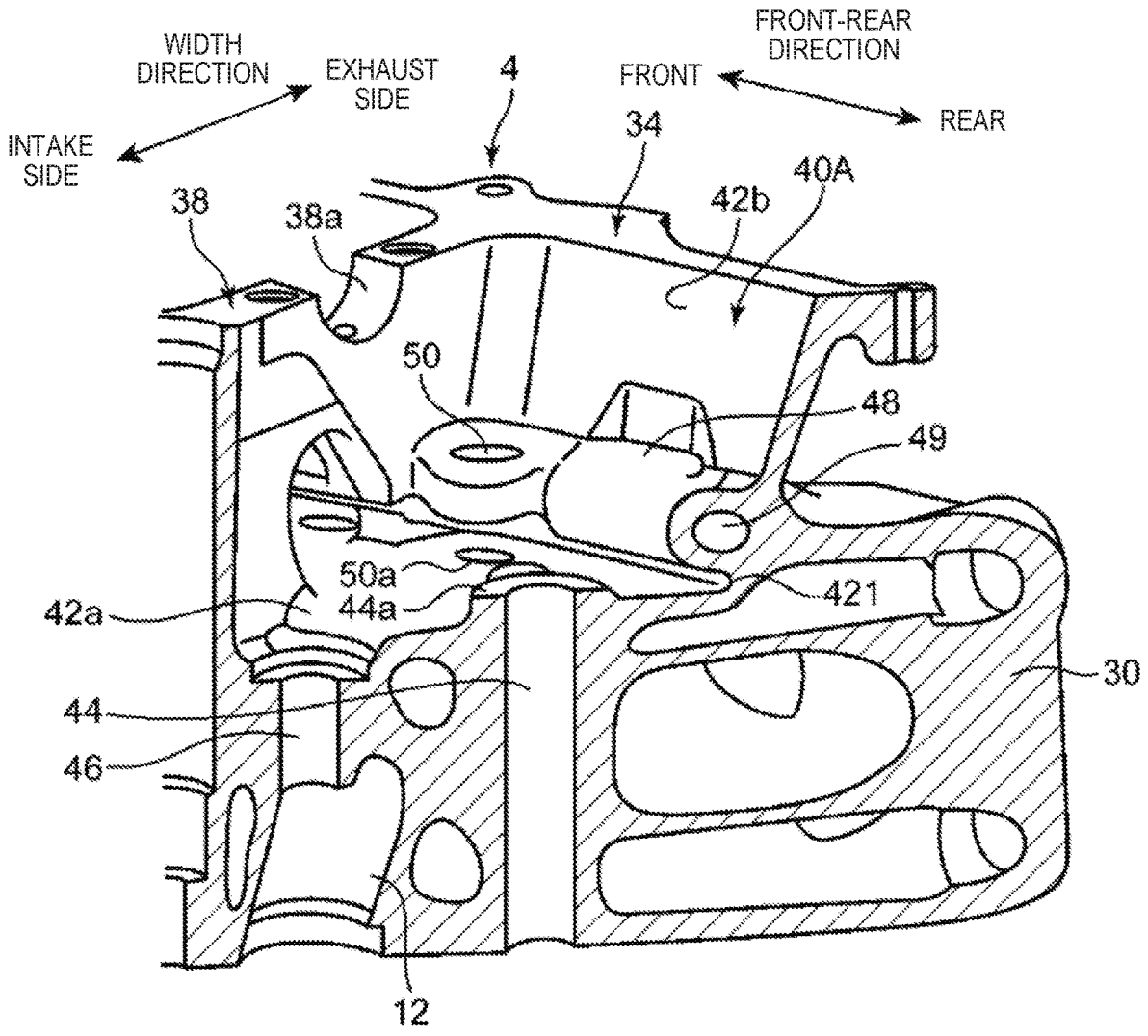
FIG. 6 is a perspective cross-sectional view of the cylinder head illustrating the inside of the exhaust-side cam chamber.

The bolt hole 44 is formed substantially in the central part of the inner bottom surface 42*a*. As illustrated in FIG. 6, the bolt hole 44 penetrates the head body 30 in the thickness direction (the vertical direction in FIG. 6). The head bolt B is inserted in this bolt hole 44 from the exhaust-side cam chamber 40A side. The head bolt B is inserted into and threadedly engaged with a nut member embedded in the cylinder block 5 or a threaded hole formed in the cylinder block 5. Therefore, the cylinder head 4 is integrally fastened with the cylinder block 5 via a gasket (not illustrated).

Figure 5:
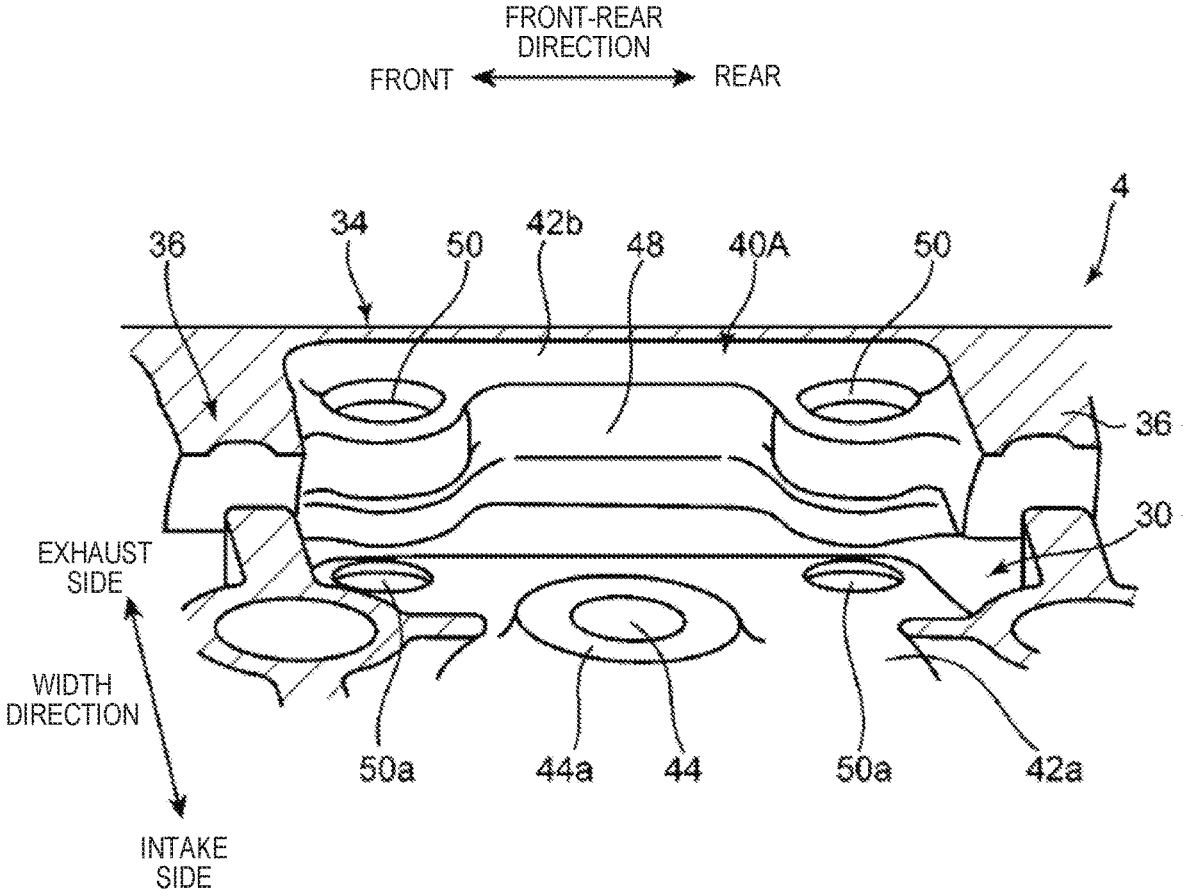
FIG. 5 is a perspective view of the inside of the exhaust-side cam chamber (exhaust-side wall part) seen from the intake side.

Note that as illustrated in FIGS. 5 and 6, a seat surface part 44*a* of annular in the plan view is formed around the bolt hole 44 so as to be bulged (protruded) inward of the chamber. By this seat surface part 44*a*, a head Bh of the head bolt B is received.

The valve holes 46 are formed at respective corner parts of the exhaust-side cam chamber 40A, in detail, at respective corner parts closer to the central wall part 32. The exhaust valve 14 is inserted in each valve hole 46 through a cylindrical valve guide 15 (see FIG. 1). In detail, a valve stem 14*a* (see FIG. 1) of the exhaust valve 14 is inserted therein.

Note that the center of each cylinder (cylinder bore 7) of the engine 1 is set at a position where the central wall part 32 and the partition wall part 38 intersect in the plan view of the cylinder head 4. Therefore, the two exhaust valves 14 which open and close the two exhaust ports 12 of the same cylinder are inserted in the valve holes 46 of the exhaust-side cam chamber 40A which are adjacent to each other in the front-and-rear direction on both sides of the partition wall part 38. That is, the exhaust valves 14 of the cylinders which are adjacent to each other are inserted into the front and rear, two valve holes 46 which are formed in the same exhaust-side cam chamber 40A.

As illustrated in FIGS. 1, 5, and 6, a protrusion 48 is formed in a side surface 42*b* (an example of an "internal surface" of the present disclosure) of the exhaust-side cam chamber 40A, which is formed by the exhaust-side wall part 34 (an example of a "side wall part" of the present disclosure), so as to protrude inwardly of the cam chamber from the side surface 42*b* at a position separated upwardly from the inner bottom surface 42*a* and extend in the front-and-rear direction.

Support holes 50 for the HLA 24 are formed at both ends of the protrusion 48 in the front-and-rear direction, i.e., in corner parts of the exhaust-side cam chamber 40A, in detail, in corner parts closer to the exhaust-side wall part 34. These support holes 50 penetrate in the thickness direction of the protrusion 48 (in the height direction of the exhaust-side wall part 34), and the HLA 24 is fitted into these support holes 50. Roughly, as illustrated in FIG. 1, the HLA 24 has a configuration in which a plunger 24*b* which receives a load from the rocker arm 20 is accommodated in a body 24*a* of a cylinder shape with a bottom so as to freely appear and disappear (slide). The body 24*a* is fitted into the support holes 50 and a lower-end part of this body 24*a* is received by the inner bottom surface 42*a* of the exhaust-side cam chamber 40A, thereby supporting the HLA 24 by the protrusion 48.

Note that a seat surface part 50*a* for the HLA 24 of a circular recess is formed at a position of the inner bottom surface 42*a* of the exhaust-side cam chamber 40A, which corresponds to each support hole 50, and a lower-end part of the HLA 24 (body 24*a*) is received by this seat surface part 50*a*.

As illustrated in FIGS. 1 and 6, an oil passage 49 is formed inside the protrusion 48 so as to extend in the front-and-rear direction. This oil passage 49 communicates with the support hole 50 through a communication passage 49*a*. A hydraulic hole (not illustrated) is formed at a position of the body 24*a* of the HLA 24 corresponding to the communication passage 49*a*. With this configuration, oil pressure for operation is supplied to the HLA 24 supported by the protrusion 48. Note that as illustrated in FIGS. 1 and 6, a part of the side surface 42*b* of the exhaust-side cam chamber 40A, which faces a space between the protrusion 48 and the inner bottom surface 42*a*, is recessed outwardly, i.e., in a direction along the inner bottom surface 42*a* heading away from the bolt hole 44 (seat surface part 44*a*).

The recessed part (referred to as a "recess 421") of the side surface 42*b* has a curved shape in the cross-section, and in this example, as illustrated in FIG. 1, it has a semicircular shape (arc shape) in the cross-section. Therefore, stress resulting from fastening the head bolt B is further eased, as described later.

Here, although the structure of the exhaust-side cam chamber 40A of the cylinder head 4 is mainly described, the structure of the intake-side cam chamber 40B is fundamentally common to the structure of the exhaust-side cam chamber 40A because it is simply symmetrical with the exhaust-side cam chamber 40A with respect to the central wall part 32, as illustrated in FIG. 4.

That is, a bolt hole 44 and a seat surface part 44*a* for the head bolt, two valve holes 46 for the intake valves, and two seat surface parts 50*a* for the HLA 24 are formed in the inner bottom surface 42*a* of the intake-side cam chamber 40B. Moreover, in a side surface 42*c* (another example of the "internal surface" of the present disclosure) of the intake-side cam chamber 40B formed by the intake-side wall part 36 (another example of the "side wall part" of the present disclosure), the protrusion 48, which protrudes from the side surface 42*c* toward the inward of the cam chamber at a position separated upwardly from the inner bottom surface 42*a* and extends in the front-and-rear direction, is formed, and support holes 50 for the HLA 24 are formed at both ends of the protrusion 48 in the front and rear directions. The HLA 24 is supported by the protrusion 48 while being fitted into the support hole 50, and oil pressure for operation is supplied to the HLA 24 through the oil passage 49 formed inside the protrusion 48.

Moreover, a part of the side surface 42*c* of the intake-side cam chamber 40B, which faces a space between the protrusion 48 and the inner bottom surface 42*a*, is recessed outwardly (downwardly and outwardly in FIG. 4). This recessed part (recess 421) has a curved shape in the cross-section, and in this example, it has a semicircle shape (arc shape) in the cross-section, similar to the recess 421 of the exhaust-side cam chamber 40A.

[3. Operation and Effects]

As described above, in the engine 1, the cylinder head 4 is fastened to the cylinder block 5 with the head bolts B, and the HLA 24 for pivotably supporting the rocker arm 20 is incorporated into the cylinder head 4.

The cylinder head 4 includes the head body 30 which forms the inner bottom surfaces 42*a* of the exhaust-side cam chambers 40A (intake-side cam chambers 40B), and the exhaust-side wall part 34 (intake-side wall part 36) which forms the side surfaces 42*b* (side surfaces 42*c*) which rise continuously from the inner bottom surfaces 42*a*. The bolt hole 44 into which the head bolt B is inserted is formed in the inner bottom surface 42*a*. Moreover, the exhaust-side wall part 34 (intake-side wall part 36) of the cylinder head 4 has the protrusion 48 which protrudes toward the inside of the cam chamber 40A (40B) from the side surface 42*b* (side surface 42*c*) at the position separated from the inner bottom surface 42*a* along the side surface 42*b* (side surface 42*c*), and the support hole 50 which can support the HLA 24 is formed in the protrusion 48.

According to such a structure of the cylinder head 4, since the part of the exhaust-side wall part 34 (intake-side wall part 36) at which the HLA 24 is supported (i.e., the protrusion 48) is separated from the inner bottom surface 42*a* of the exhaust-side cam chamber 40A (intake-side cam chamber 40B), the generated position of the stress resulting from the deformation of the inner bottom surface 42*a* caused by fastening of the head bolt B separates from the fastening position of the head bolt B (the bolt hole 44 and the seat surface part 44*a*) by the separated amount of the protrusion 48. Therefore, according to the cylinder head 4, the stress is eased, compared with the cylinder head of the conventional structure, thereby reducing the generation of a crack, etc., in the cylinder head 4.

Figure 7:
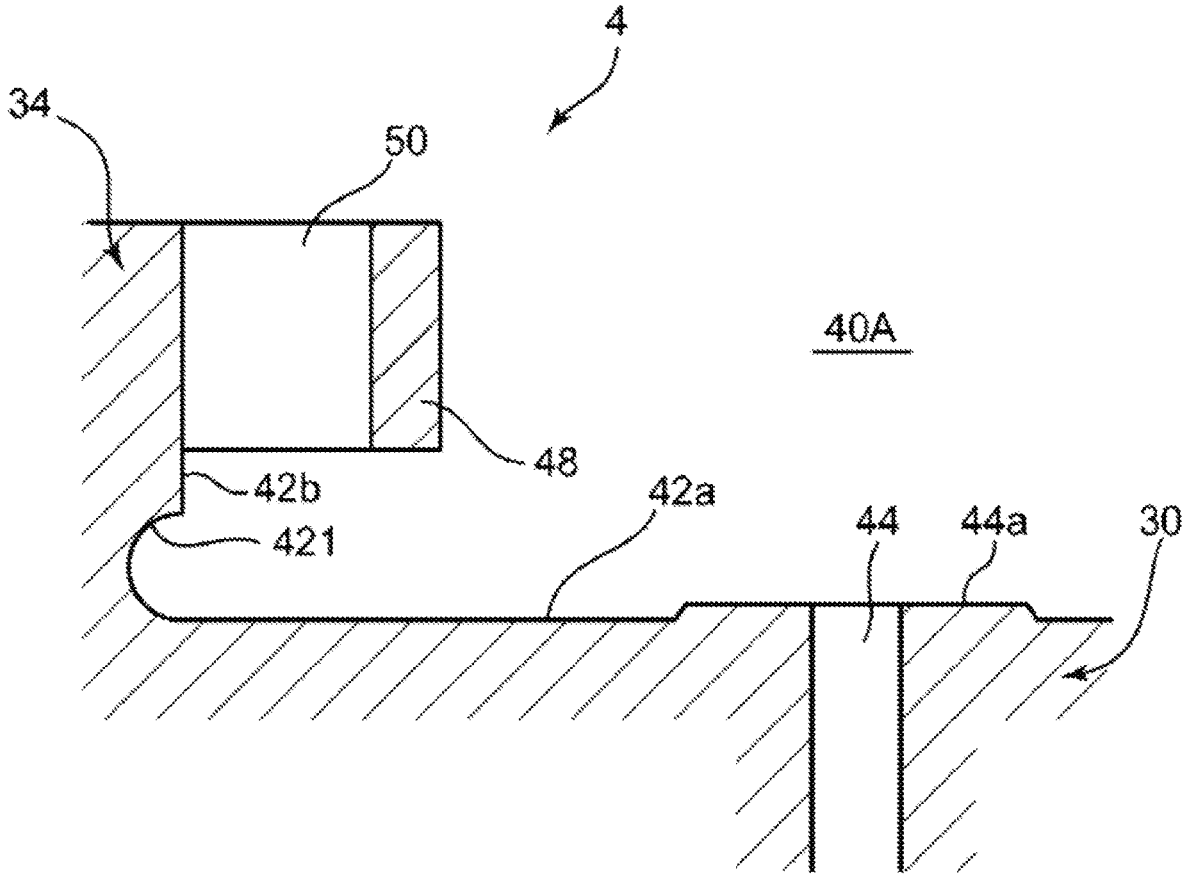
FIG. 7 is a cross-sectional view schematically illustrating the cylinder head according to one embodiment (the cross-sectional view taken along a line VII-VII in FIG. 4).

This is described in detail using the drawings. FIG. 7 is a cross-sectional view of the cylinder head 4 of the embodiment (the cross-sectional view taken along the line VII-VII in FIG. 4), and FIG. 9 is a cross-sectional view of a cylinder head 4' according to a comparative example corresponding to the cross-sectional view taken along the line VII-VII in FIG. 4.

The cylinder head 4 illustrated in FIG. 7 has the structure as already described. That is, the bolt hole 44 and the seat surface part 44*a* of the head bolt B are formed in the inner bottom surface 42*a* of the exhaust-side cam chamber 40A, and the protrusion 48 having the support hole 50 for supporting the HLA 24 is protruded from the exhaust-side wall part 34 (side surface 42*b*). Moreover, the recess 421 is formed in the part of the side surface 42*b*, which faces the space between the inner bottom surface 42*a* and the protrusion 48.

Figure 9:
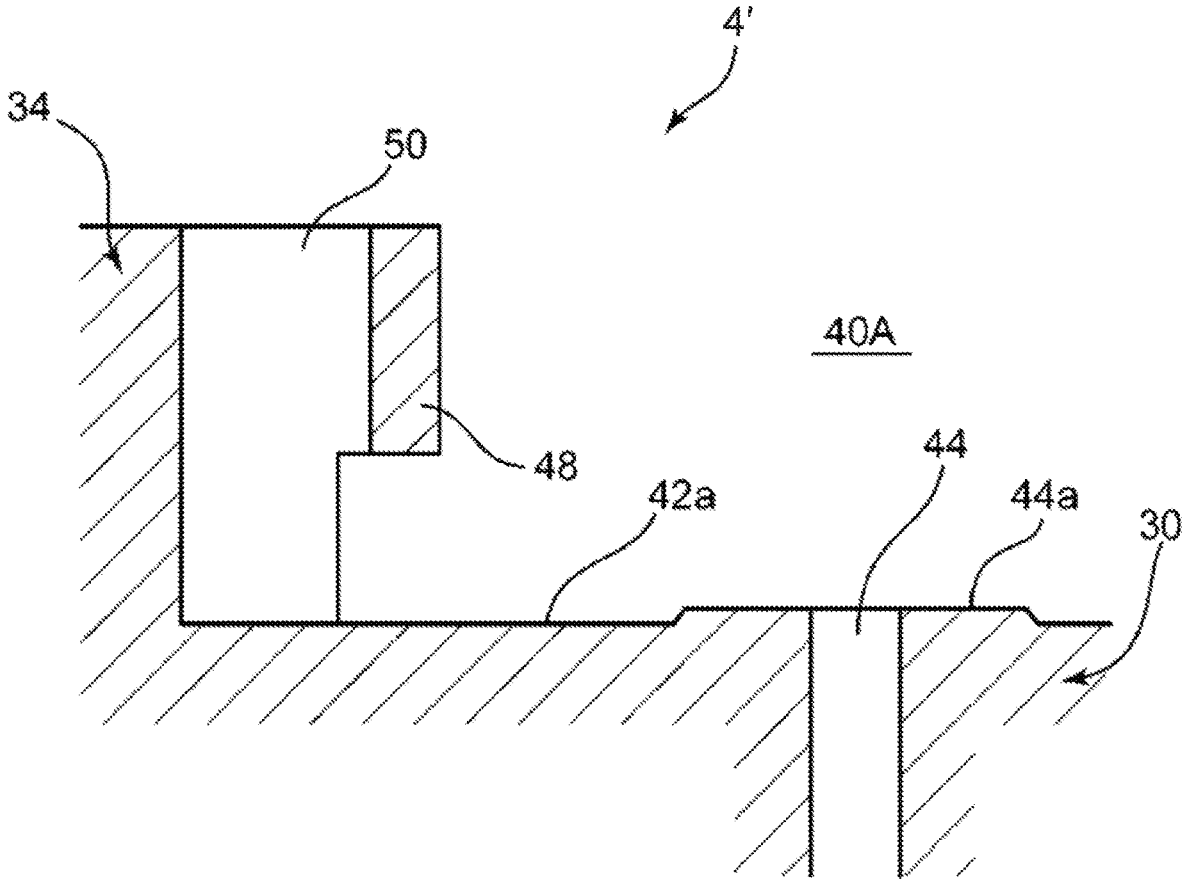
FIG. 9 CONVENTIONAL ART
FIG. 9 is a cross-sectional view schematically illustrating a cylinder head according to a comparative example (conventional example) (a schematic cross-sectional view corresponding to the cross-sectional view taken along the line VII-VII in FIG. 4).

On the other hand, the cylinder head 4' of the comparative example illustrated in FIG. 9 assumes the cylinder head of the conventional structure. That is, in this cylinder head 4', the protrusion 48 is partially coupled to the inner bottom surface 42*a* of the exhaust-side cam chamber 40A, and the recess 421 as illustrated in FIG. 7 is not formed in the exhaust-side wall part 34. Note that other structures of the cylinder head 4' are common to the cylinder head 4 of FIG. 7.

In either of the cylinder head 4 or 4', when the head bolt B is fastened to the cylinder block 5, the seat surface part 44*a* is depressed toward the cylinder block 5 by the fastening, which causes a deformation of the perimeter of the seat surface part 44*a*. Such a depression of the seat surface part 44*a* becomes larger as the fastening force of the head bolt B relatively increases.

Figure 10:
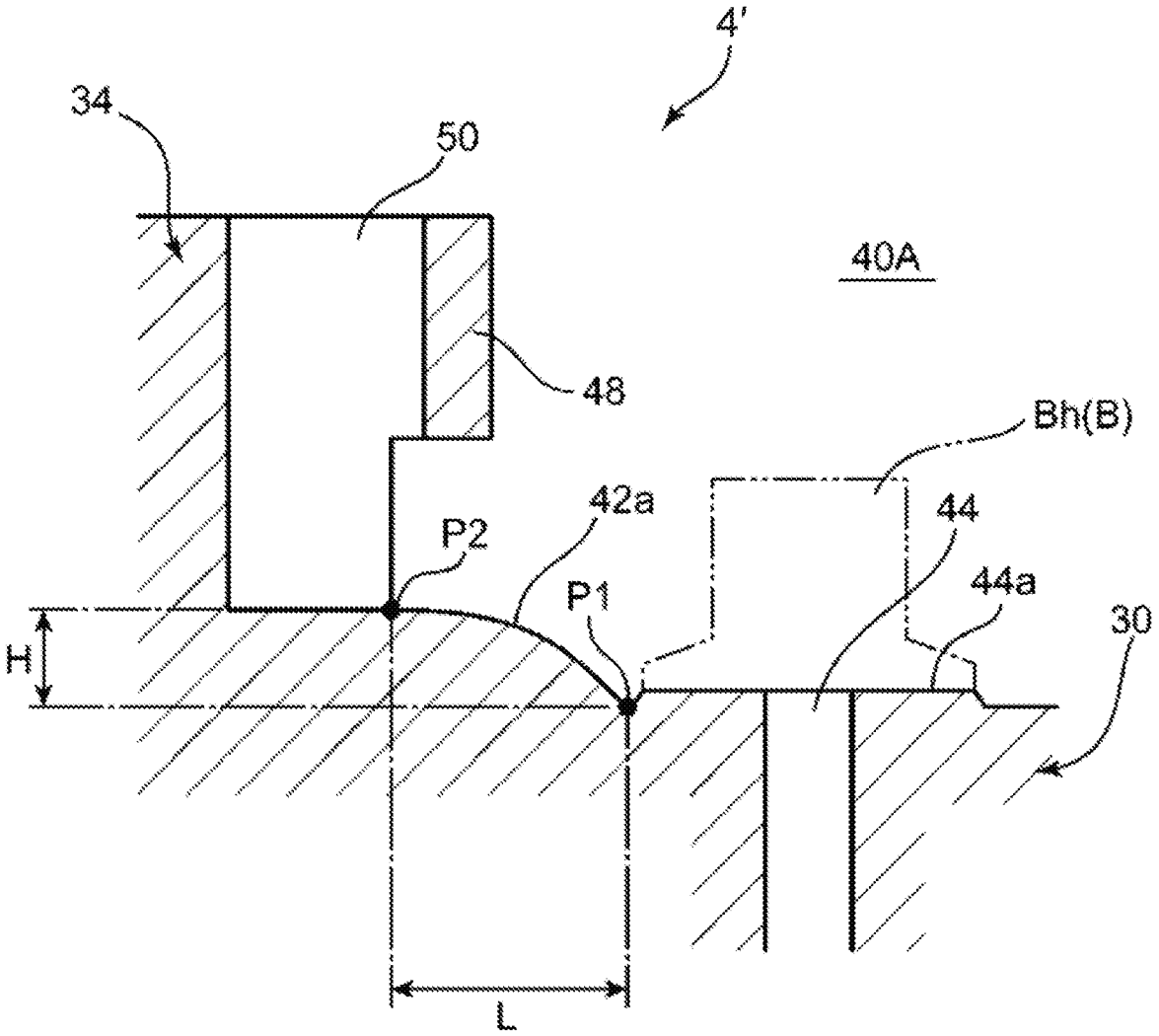
FIG. 10 CONVENTIONAL ART
FIG. 10 is a cross-sectional view schematically illustrating the cylinder head according to the comparative example in a state where a head bolt is fastened.

Here, in the cylinder head 4' of the comparative example in which the protrusion 48 is coupled to the inner bottom surface 42*a*, since the protrusion 48 is restrained by the exhaust-side wall part 34, the protrusion 48 cannot follow the displacement of the inner bottom surface 42*a* as illustrated in FIG. 10. That is, in the cylinder head 4' of the comparative example, a difference in the rigidity occurs between the protrusion 48 and the inner bottom surface 42*a*, at a boundary part P2 which is a connection part therebetween. Therefore, stress according to a depressed amount H of the seat surface part 44*a*, and a distance L from a starting point P1 of the depression (the circumferential edge of the seat surface part 44*a*) to the boundary part P2 occurs at this boundary part P2.

Figure 8:
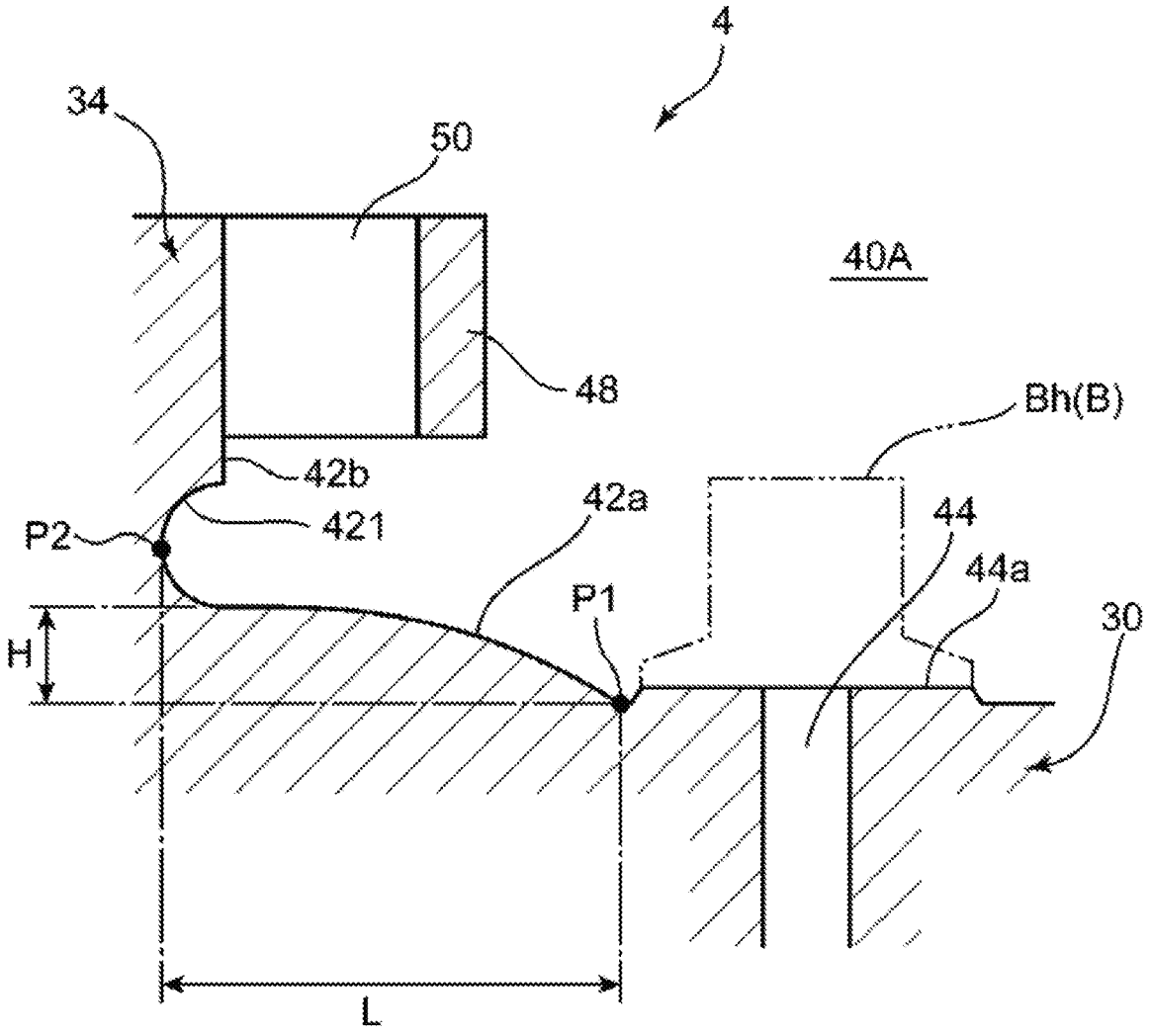
FIG. 8 is a cross-sectional view schematically illustrating the cylinder head according to the embodiment in a state where a head bolt is fastened.

On the other hand, in the cylinder head 4 of this embodiment, the protrusion 48 is not coupled to the inner bottom surface 42*a*. In addition, the recess 421 of the semicircular shape (arc shape) in the cross-section, which is recessed so as to be separated from the bolt hole 44 (head bolt B), is formed in the part of the side surface 42*b* of the exhaust-side wall part 34, which faces the space between the protrusion 48 and the inner bottom surface 42*a*. With such a structure, as illustrated in FIG. 8, the position at which the rigidity difference occurs (i.e., the boundary part P2 of the rigidity difference) becomes the top of the recess 421. Therefore, the distance L from the depression starting point P1 to the boundary part P2 becomes larger than the distance L of the cylinder head 4' of the comparative example.

Here, the magnitude of the stress caused at the boundary part P2 becomes larger as the depressed amount H relatively increases and becomes larger as the distance L is relatively shortened. Therefore, if the fastening torque of the head bolt B is the same, the stress caused at the boundary part P2 becomes smaller (eased) in the cylinder head 4 of this embodiment in which the distance L from the depression starting point P1 to the boundary part P2 becomes longer, compared with the cylinder head 4' of the comparative example. Therefore, according to the cylinder head 4 of this embodiment, it can be said that the generation of a crack, etc. resulting from the fastening of the head bolts B can be reduced, compared with the cylinder head of the conventional structure.

[4. Modifications, etc.]

As described above, although the cylinder head 4 according to the embodiment of the present disclosure is described, the cylinder head 4 described above is an illustration of a desirable embodiment of the cylinder head according to the present disclosure, and its specific structure may suitably be changed without departing from the spirit of the present disclosure. For example, the cylinder head 4 may be structured as follows.

(1) In the cylinder head 4 of this embodiment, the recess 421 of the semicircular shape (arc shape) in the cross-section is formed in the part of the side surface 42*b* of the exhaust-side wall part 34 which forms the exhaust-side cam chamber 40A, which faces the space between the inner bottom surface 42*a* and the protrusion 48. However, the cross-sectional shape of the recess 421 is not limited to the arc shape and may be any curved cross-sectional shapes other than the arc shape.

Figure 11:
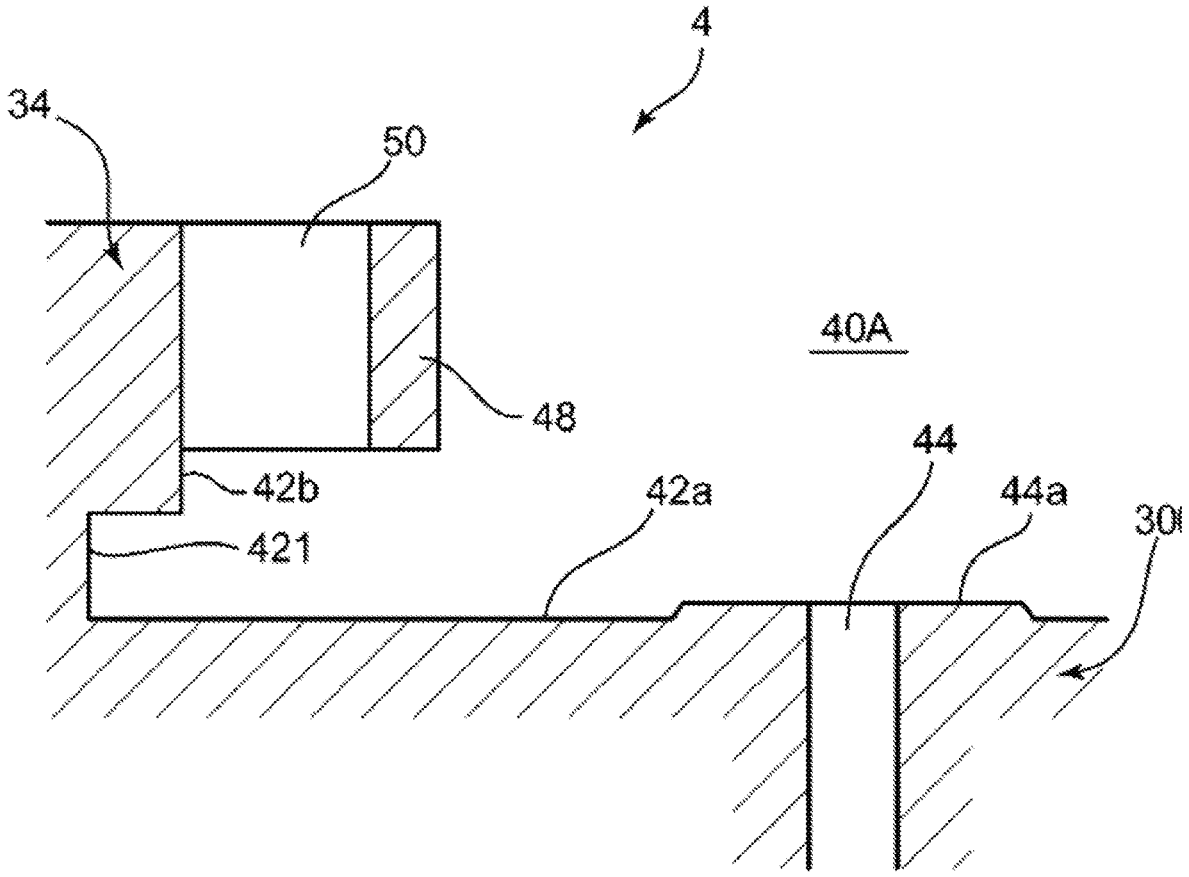
FIG. 11 is a cross-sectional view schematically illustrating a cylinder head according to a modification (a schematic cross-sectional view corresponding to the cross-sectional view taken along the line VII-VII in FIG. 4).

(2) Moreover, the recess 421 may have any shapes other than the curved cross-sectional shape, in detail, may have a rectangular or triangular cross-sectional shape (a cross-sectional shape with a corner part). For example, FIG. 11 illustrates one example in which a square cross-sectional shape is adopted as a recess 421. In this case, the connection part of the deep end surface of the recess 421 and the inner bottom surface 42*a* becomes the boundary part P2 of the rigidity difference.

Figure 12:
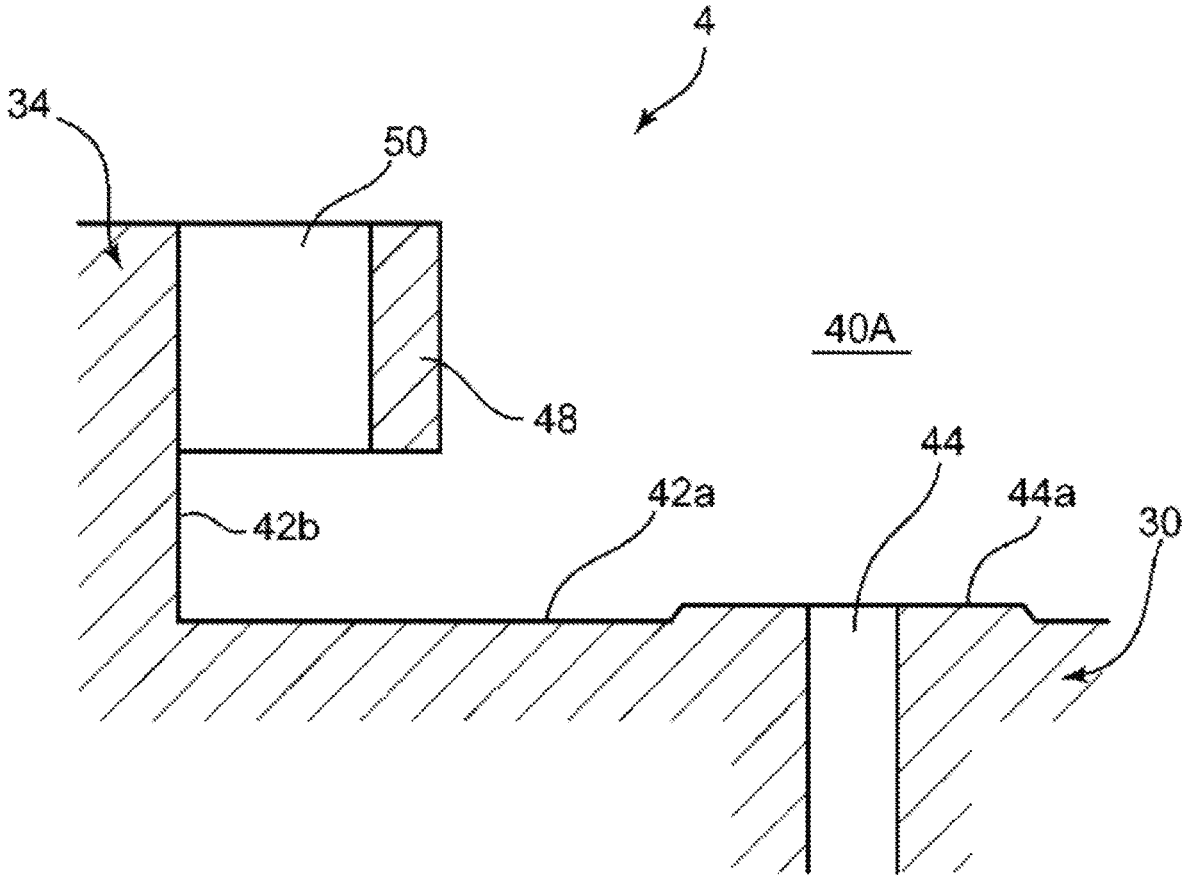
FIG. 12 is a cross-sectional view schematically illustrating a cylinder head according to another modification (a schematic cross-sectional view corresponding to the cross-sectional view taken along the line VII-VII in FIG. 4).

(3) Although in the cylinder head 4 of this embodiment the recess 421 is formed in the side surface 42*b* of the exhaust-side wall part 34 which forms the exhaust-side cam chamber 40A, the recess 421 may be eliminated as illustrated in FIG. 12. According to the structure of the cylinder head 4 illustrated in FIG. 12, the connection part of the side surface 42*b* of the exhaust-side cam chamber 40A and the inner bottom surface 42*a* becomes the boundary part P2 of the rigidity difference. Even in such a structure, the distance L from the depression starting point P1 to the boundary part P2 becomes longer than the conventional cylinder head (see FIGS. 9 and 10). Therefore, the stress resulting from the fastening of the head bolt B can be eased also by the structure of the cylinder head 4 illustrated in FIG. 12, thereby reducing the generation of a crack, etc.

(4) In this embodiment, the HLA 24 is applied as the pivot member which pivotably supports the rocker arm 20. However, the present disclosure can be applied also to cylinder heads in which the pivot member other than the HLA 24 is incorporated, and therefore, operation and effects equivalent to the cylinder head 4 of this embodiment can be expected from this application.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine
4 Cylinder Head
5 Cylinder Block
12 Exhaust Port
14 Exhaust Valve
20 Rocker Arm
20*a* Cam Follower
24 Hydraulic Lash Adjuster (HLA, Pivot Member)
30 Head Body (Bottom Wall Part)
32 Central Wall Part
34 Exhaust-side Wall Part (Side Wall Part)
36 Intake-side Wall Part (Side Wall Part)
38 Partition Wall Part
40A Exhaust-Side Cam Chamber
40B Intake-Side Cam Chamber
42*a* Inner Bottom Surface
42*b*, 42*c* Side Surface (Internal Surface)
421 Recess
44 Bolt Hole
44*a*, 50*a* Seat Surface Part
48 Protrusion
50 Support Hole
B Head Bolt
Bh Head

What is claimed is:

1. A cylinder head for fastening to a cylinder block via a bolt, the cylinder head comprising:

a hydraulic lash adjuster configured to pivotally support a rocker arm;

a bottom wall part forming an inner bottom surface of an exhaust-side cam chamber that is a space where the rocker arm is disposed; and a side wall part forming an internal surface continuously rising from the inner bottom surface, wherein the bolt is inserted into a bolt hole formed in the inner bottom surface, wherein the side wall part includes a protrusion extending into the exhaust-side cam chamber from the internal surface at a position separated from the inner bottom surface, the protrusion including a support hole configured to support the hydraulic lash adjuster, wherein a first portion of the internal surface, between the protrusion and the inner bottom surface, is recessed away from the bolt hole, and wherein a lower-end portion of the hydraulic lash adjuster is supported by a seat surface formed in the inner bottom surface between the first portion and the bolt hole.

2. The cylinder head of claim 1, wherein the first portion has a curved cross-sectional shape.

3. The cylinder head of claim 2, wherein the exhaust-side cam chamber has a rectangular shape in a plan view, the bolt hole is formed substantially at a center of the inner bottom surface, and the hydraulic lash adjuster is disposed at a corner part of the exhaust-side cam chamber in the plan view.

4. The cylinder head of claim 1, wherein the first portion has a rectangular cross-sectional shape.

5. The cylinder head of claim 4, wherein the exhaust-side cam chamber has a rectangular shape in a plan view, the bolt hole is formed substantially at a center of the inner bottom surface, and the hydraulic lash adjuster is disposed at a corner part of the exhaust-side cam chamber in the plan view.

6. The cylinder head of claim 1, wherein the hydraulic lash adjuster is configured to automatically carry out a zero-point adjustment of a valve clearance.

7. The cylinder head of claim 1, wherein the exhaust-side cam chamber has a rectangular shape in a plan view, the bolt hole is formed substantially at a center of the inner bottom surface, and the hydraulic lash adjuster is disposed at a corner part of the exhaust-side cam chamber in the plan view.

8. The cylinder head of claim 1, wherein the first portion has a semicircular cross-sectional shape.

9. The cylinder head of claim 1, wherein an axis of the support hole is parallel to an axis of the bolt hole such that the hydraulic lash adjuster in the support hole is parallel to the bolt in the bolt hole.

* * * * *